US006338494B1

(12) United States Patent
Killian

(10) Patent No.: US 6,338,494 B1
(45) Date of Patent: Jan. 15, 2002

(54) ARTICULATED TWO WHEEL BOARD

(76) Inventor: Michael Killian, 32 Westland Ave., Apt. 16, Boston, MA (US) 02115

( * ) Notice: Subject to any disclaimer, the term of this patent is extended or adjusted under 35 U.S.C. 154(b) by 0 days.

(21) Appl. No.: 09/768,946

(22) Filed: Jan. 24, 2001

(51) Int. Cl.[7] ..... A63C 17/00

(52) U.S. Cl. ..... 280/87.042

(58) Field of Search ..... 280/87.021, 87.041, 280/87.042, 87.01, 87.05, 87.043, 87.03

(56) References Cited

U.S. PATENT DOCUMENTS

| | | | | | |
|---|---|---|---|---|---|
| 3,023,022 | A | * | 2/1962 | Boyden | 280/87.042 |
| 4,163,565 | A | * | 8/1979 | Weber | 280/7.13 |
| 5,090,716 | A | * | 2/1992 | Borden | 280/87.042 |
| 5,160,155 | A | | 11/1992 | Barachet | 280/87.042 |
| 5,505,474 | A | * | 4/1996 | Yeh | 280/87.042 |
| 5,540,455 | A | * | 7/1996 | Chambers | 280/87.042 |
| 5,794,955 | A | | 8/1998 | Flynn | 280/87.042 |
| 6,206,390 | B1 | * | 3/2001 | Borg | 280/87.042 |

* cited by examiner

*Primary Examiner*—Michael Mar

(57) ABSTRACT

A two wheel articulated board device which the user can operate on smooth rough or smooth terrain. The device has a rear board member and a front board member which are connected at a pivot point. Each board member can rotate relative to the other board member around this pivot point. The device is supported by two wheels. A rear wheel which extends rear of the board and above the level of the board and a front wheel which extends forward of the board and above the level of the board. The front wheel is connected to the board by a front fork which attaches to the underside of the board. The rear wheel is connected to the board by a rear fork which attaches to the underside of the board. There is a flexible member that connects at one end with the underside of the device rear of the pivot point and at the other end at the underside of the device forward of the pivot point. The user motions the board forward by placing one foot on the rear board member with that foot oriented about 45 degrees off the major axis of the device. Forward motion is achieved by the user pushing against the ground with his/her other foot. Once the user has gained enough speed and begins coasting, the user repositions his/her feet perpendicular to the long axis of the device. While coasting the user can affect a change of direction by changing the relative orientation of his/her feet which are initially parallel without lifting them off the device. Moving the user's feet by bringing his/her toes closer together causes the rear board member to move relative to the front board member around the pivot point and thus affects a change of direction of the device. A flexible member running under the device along the major axis of the device and connected at one end to the rear board member and at the other end to the front board member applies a force to keep each board member aligned along their respective major axes.

3 Claims, 8 Drawing Sheets

ARTICULATED TWO WHEEL BOARD

FIELD OF THE INVENTION

The present invention relates to board based recreational devices like skateboards and mountain boards.

BACKGROUND OF THE INVENTION

There are many types of board based recreational devices. These include skateboards with four wheels for operation on pavement; mountain boards with four wheels for operation on rough terrain and inline skateboards for operation on pavement.

The prior art includes a plurality of mountain boards with four wheels that extend above the level of the board. For example, U.S. Pat. No. 5,794,955 describes such a four wheel mountain board.

The prior art includes U.S. Pat. No. 5,160,155 which discloses a skateboard having two wheels in tandem. This patent also discloses a spring based mechanism for dampening and centering the front steering wheel. The front steering wheel is positioned rear of the point of pivot between the wheel and the skateboard.

SUMMARY OF THE INVENTION

It is an object of the present invention to provide an articulated two wheel board device for operation on rough and smooth terrain.

It is a more particular object of the invention to provide a board that is made up of two sections, the front board member and the rear board member.

It is another object of the invention to provide a pivot point where the front board member connects to the rear board member.

It is another object of the invention to provide a rear wheel that extends behind the rear board member and above the level of the rear board member and attached to the rear board member. It is another object of the present invention to provide a front wheel that extends in front of the front board member and above the level of the front board member and attached to the front board member.

Preferably the front wheel is connected to the front board member by means of a front fork member which attaches to the front wheel axle.

Preferably the rear wheel is connected to the rear board member at the rear pivot point by means of a rear fork which attaches to the rear wheel axle.

It is another object of the invention to provide the pivot point which includes thrust bearings, thrust bearing races, a pivot bolt and a pivot nut.

In some embodiments there is a flexible rod that runs under the board members along the long axis the length of both board members and is attached at one end to the rear fork member and the other end at the front fork member In some embodiments the board member is constructed of 13 ply birch which gives it great stiffness and can support the pivot point.

In some embodiments the board member is constructed of different material.

DESCRIPTION OF THE DRAWINGS

These and other aspects of the present invention will become more evident upon reading the following description of the preferred embodiment in conjunction with the accompanying drawings, in which.

DETAILED DESCRIPTION OF PREFERRED EMBODIMENTS

Figure 1:
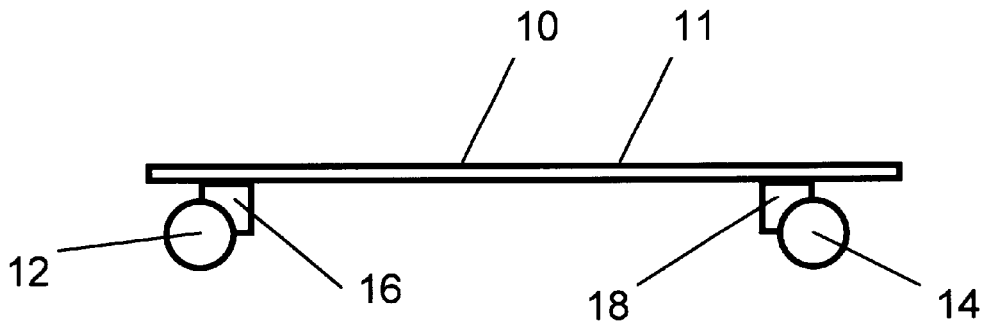
Fig. 1 PRIOR ART
FIG. 1 is a prior art side view of a skateboard.
Figure 2:
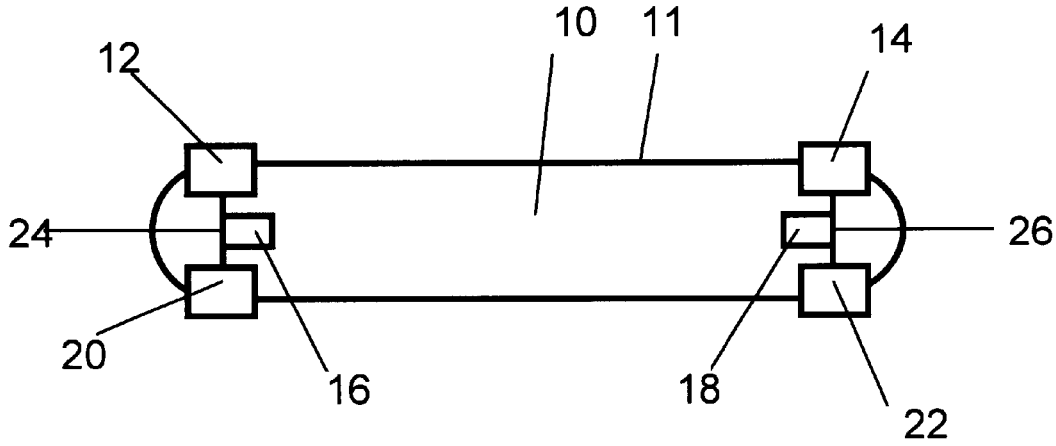
Fig. 2 PRIOR ART
FIG. 2 shows the skateboard of FIG. 1 as seen from the underside.

FIG. 1 and FIG. 2 illustrates a prior art skateboard device 10. In FIG. 1 and FIG. 2 the board member 11 is supported from below by four wheels 12, 14, 20 and 22. Wheels 12 and 20 are connected together by axle 24. Wheels 14 and 22 are connected together by axle 26. Axle 24 is connected to the board 11 by truck 16. Axle 26 is connected to the board 11 by truck 18.

Figure 3:
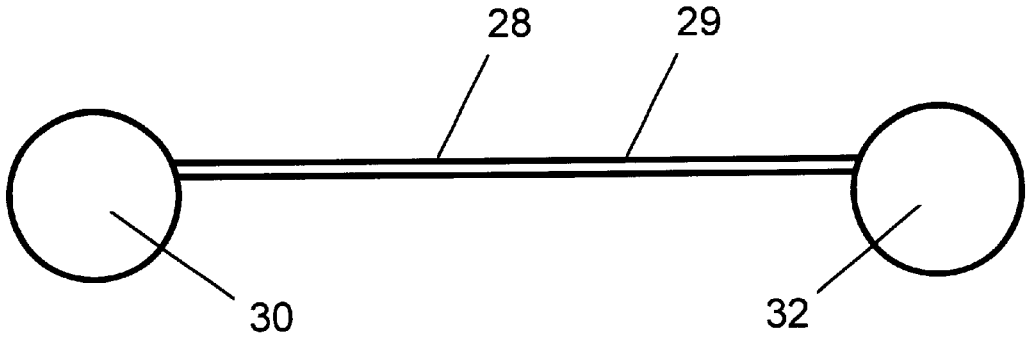
Fig. 3 PRIOR ART
FIG. 3 is a prior art side view of a mountain board.
Figure 4:
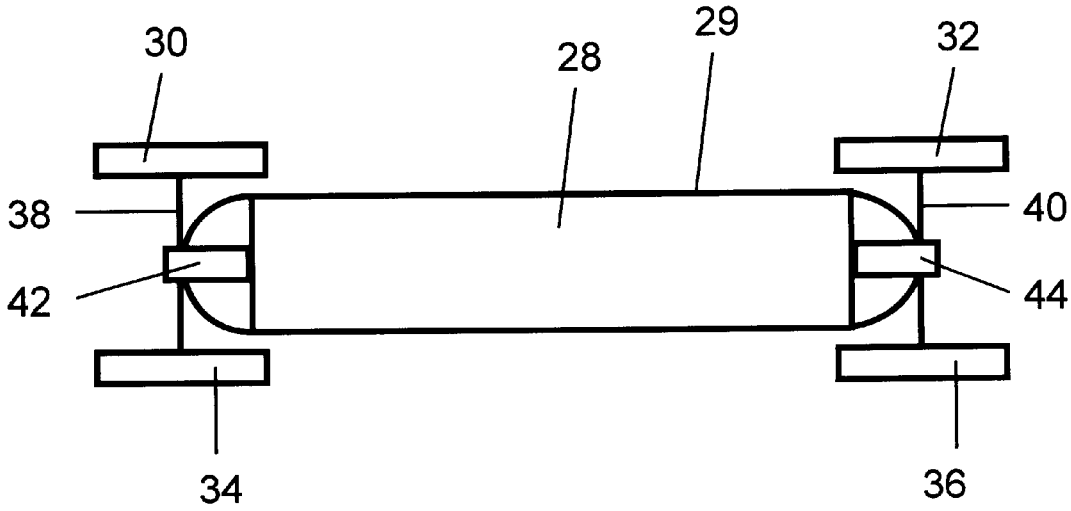
Fig. 4 PRIOR ART
FIG. 4 shows the mountain board of FIG. 3 as seen from the underside.

FIG. 3 and FIG. 4 illustrates a prior art mountain board device 28. In FIG. 3 and FIG. 4 the board member 29 is supported from below by four wheels 30, 32, 34 and 36. Wheels 30 and 34 are connected together by axle 38. Wheels 32 and 36 are connected together by axle 40. Axle 38 is connected to the board 29 by truck 42. Axle 40 is connected to the board 29 by truck 44.

Figure 5:
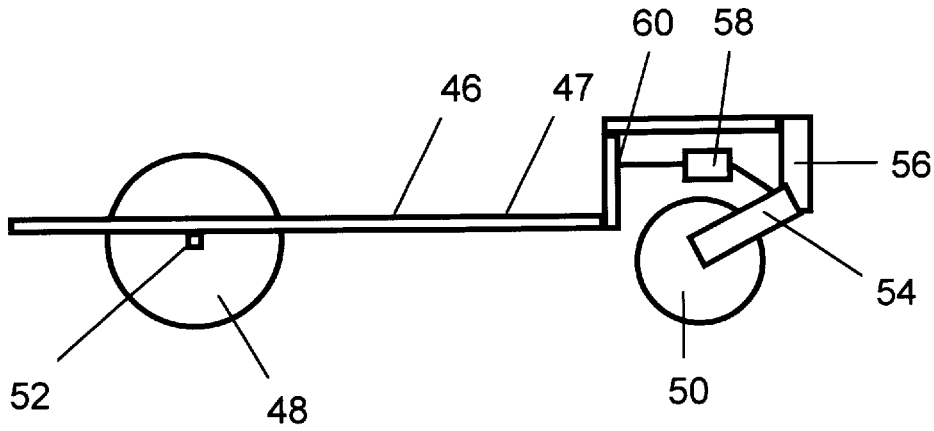
Fig. 5 PRIOR ART
FIG. 5 is a prior art view of a skateboard having two wheels in tandem.
Figure 6:
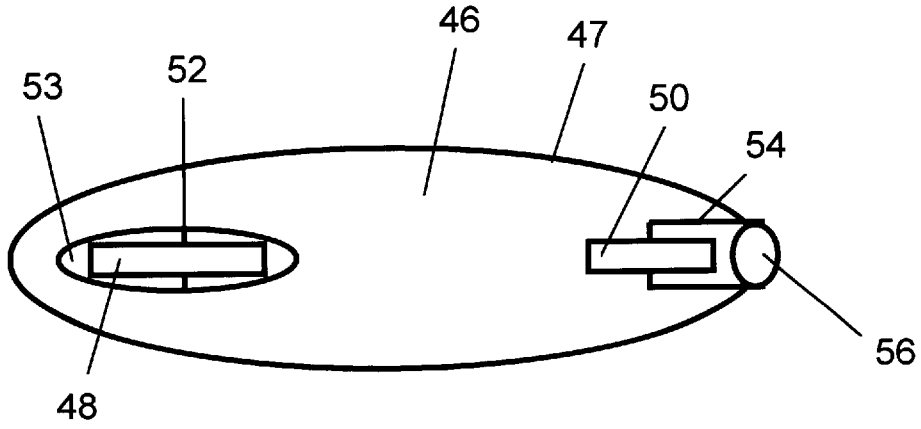
Fig. 6 PRIOR ART
FIG. 6 shows the skateboard of FIG. 5 as seen from the underside.

FIG. 5 and FIG. 6 illustrates a prior art skateboard device 46. In FIG. 5 and FIG. 6 the board member 47 is supported by a rear wheels 48 and a front wheel 50. Rear wheels 48 extends through the board member 47 through opening 53 and is attached to the board member 47 at axle 52. The front wheel 50 is connected to the board 47 by fork 54 connected at pivot 56 which is forward of front wheel 50. Pivot 56 allows fork 54 and wheel 50 to move perpendicular to the axis through pivot 56. Wheel 50 is centered with axis perpendicular to the long axis of the board 47 by spring 58 which connects at one end to the rear of fork 54 and at the other end to board 47 at attachment point 60. A user riding this board can affect a change of direction by shifting his/her weight on the board. Under weight shifting conditions the fork 54 and front wheel 50 moves perpendicular to the axis at pivot 56. This motion is much like a caster on a shopping cart. The spring 56 dampens and governs the motion. When the user's weight is more directly centered along the long axis of board 47, the axis of wheel 50 will return to a position perpendicular to the long axis of board 47.

Figure 7:
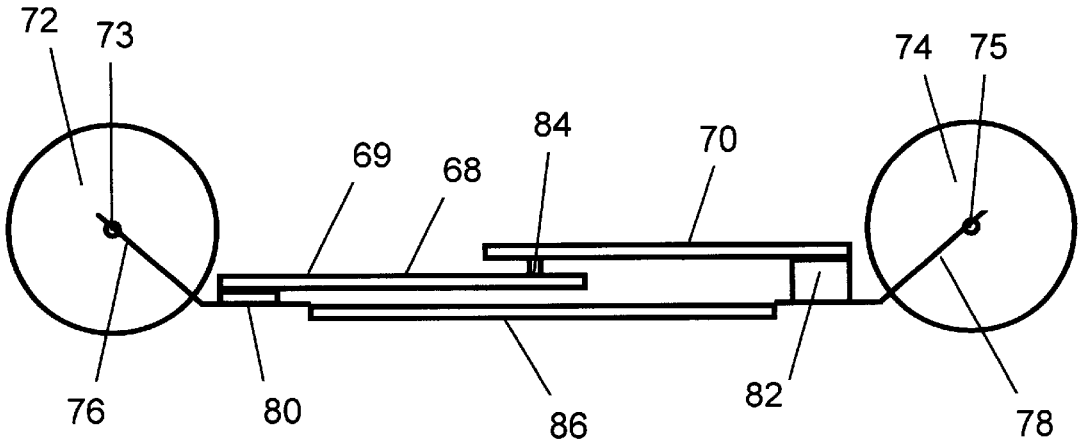
FIG. 7 is a side view of the present invention.
Figure 8:
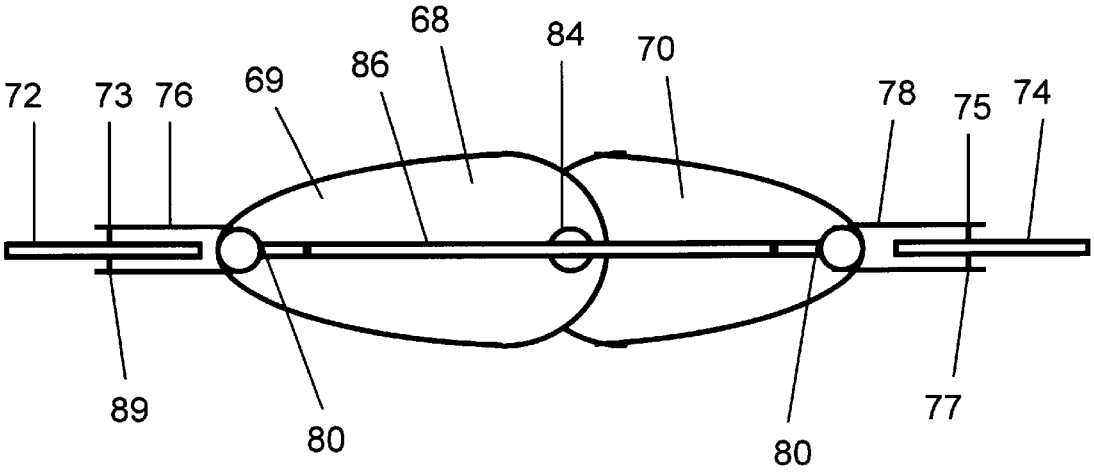
FIG. 8 shows the present invention of FIG. 7 as seen from the underside.
Figure 9:
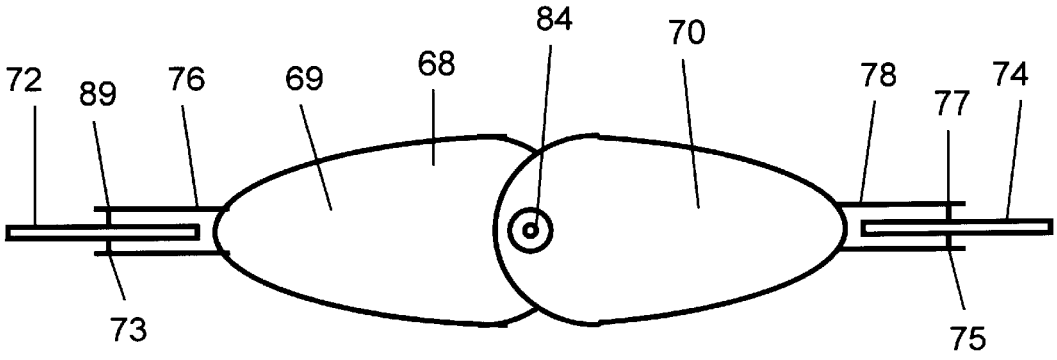
FIG. 9 shows the present invention of FIG. 7 as seen from the top.

FIG. 7, FIG. 8 and FIG. 9 illustrates the current invention 68. In FIG. 7, FIG. 8 and FIG. 9 the rear board member 69 is supported from the ground by wheel 72. The rear wheel 72 extends to the rear of board member 69 and extends above the level of board member 69. The front board member 70 is supported from the ground by wheel 74. The front wheel 74 extends to the front of board member 70 and extends above the level of board member 70.

The rear board member 69 is attached to the front board member 70 at pivot point 84. The front wheel 74 is attached to fork member 78 at connection points 75 and 77 and extends under the front of board member 70 and connects with board member 70 at 82. The rear wheel 72 is attached to fork member 76 at connection points 73 and 89 and extends under the rear of board member 69 and connects with board member 69 at 80.

A flexible member 86 connects the rear of front fork 76 a with the front of rear fork 78.

The user places one foot on rear board member 69 with that foot oriented about 45 degrees relative to the major axis of the device and is propelled forward by the user pushing against the ground with his/her other foot. This motion is much like the typical means of propelling a skateboard forward. The flexible member 86 gives the invention a false center which keeps the major axes of each board member in alignment even when the user's foot is not on either board member.

Once the user has achieved a satisfactory rate of speed from this means, the user can place the other foot on the front board member 70 orienting each foot in a direction perpendicular to the long axis of the device. With both feet oriented perpendicular to the major axis of both board members 69 and 70, the user has more control over the invention and can affect a change in direction by moving the front and rear board member around the pivot point 84 with the user's feet. The user's weight and feet motion can overcome the centering force of the flexible member 86.

Figure 10:
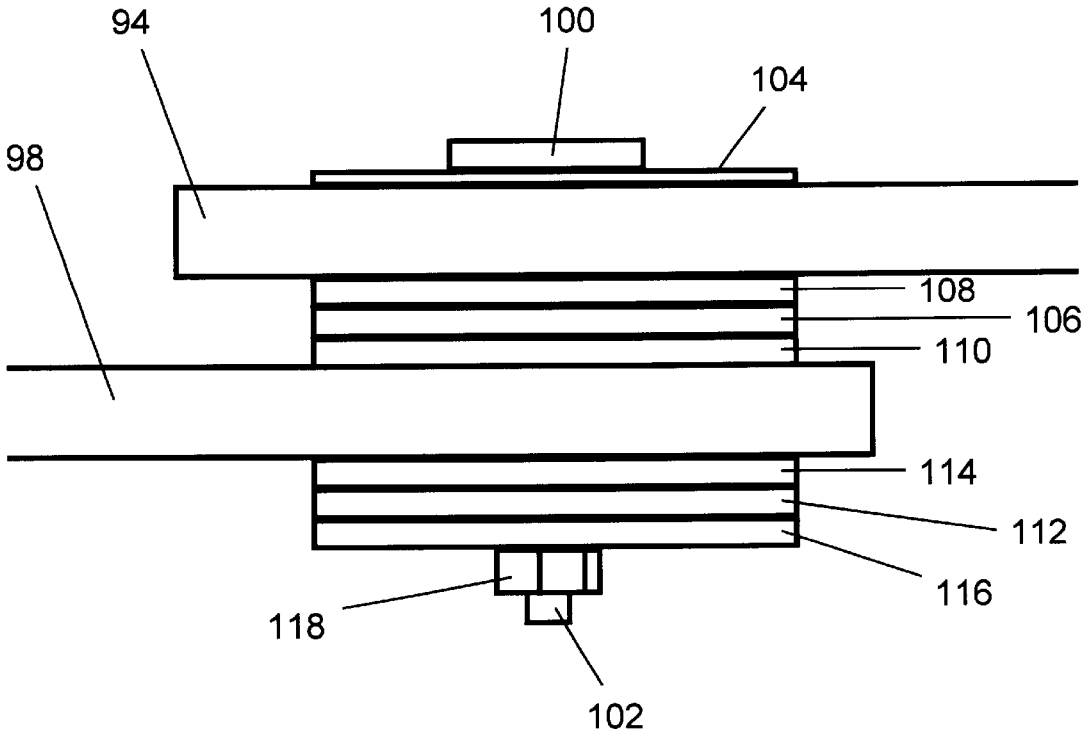
FIG. 10 is a side view of a portion of the present invention which details the pivot point.

FIG. 10 is a side view of a portion of the present invention which details the pivot point. In FIG. 10 the pivot bolt 100 extends through front board member 94 and rear board member 98 and is visible as 102. A heavy gauge washer 104 spreads the load of pivot bolt 100. Pivot bolt 100 also passes through thrust bearing 106, top thrust bearing race 108 and bottom thrust bearing race 110. Pivot bolt 100 also passes through thrust bearing 112, top thrust bearing race 114 and bottom thrust bearing race 116. Pivot bolt 100 is secured against bottom thrust bearing race 116 by nut 118. When pivot bolt 100 is secured by nut 118, rear board member 98 and front board member 94 are free to rotate around pivot bolt 100. Industrial strength thrust bearings and bearing races allow rear board member 98 and front board member 94 to rotate around pivot bolt 100 irrespective of the downward pressure of the user standing on the device.

Figure 11:
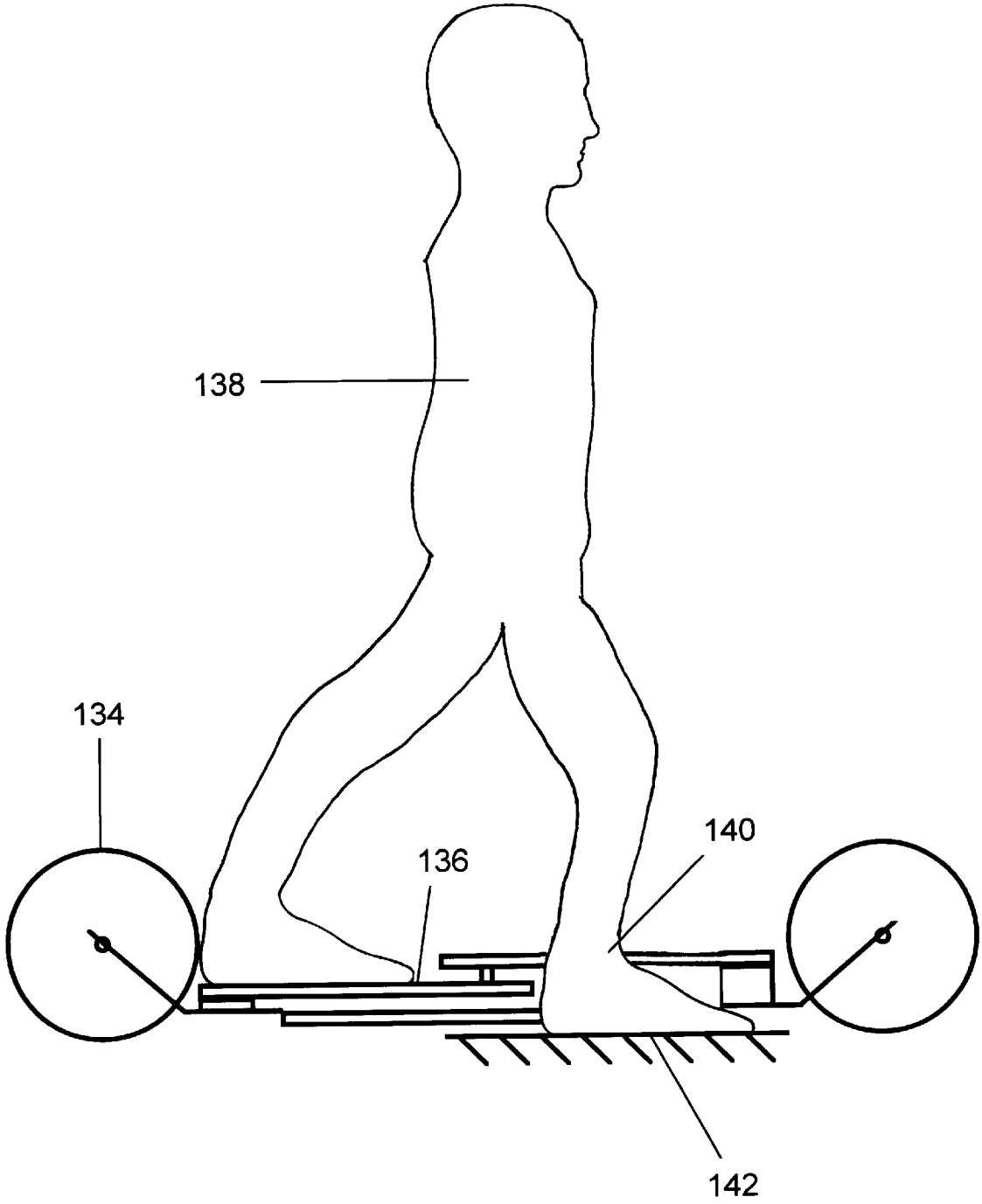
FIG. 11 is a side view of a user riding the current invention during the power stroke where the user obtains forward motion from contact of the user's foot and the ground.
Figure 12:
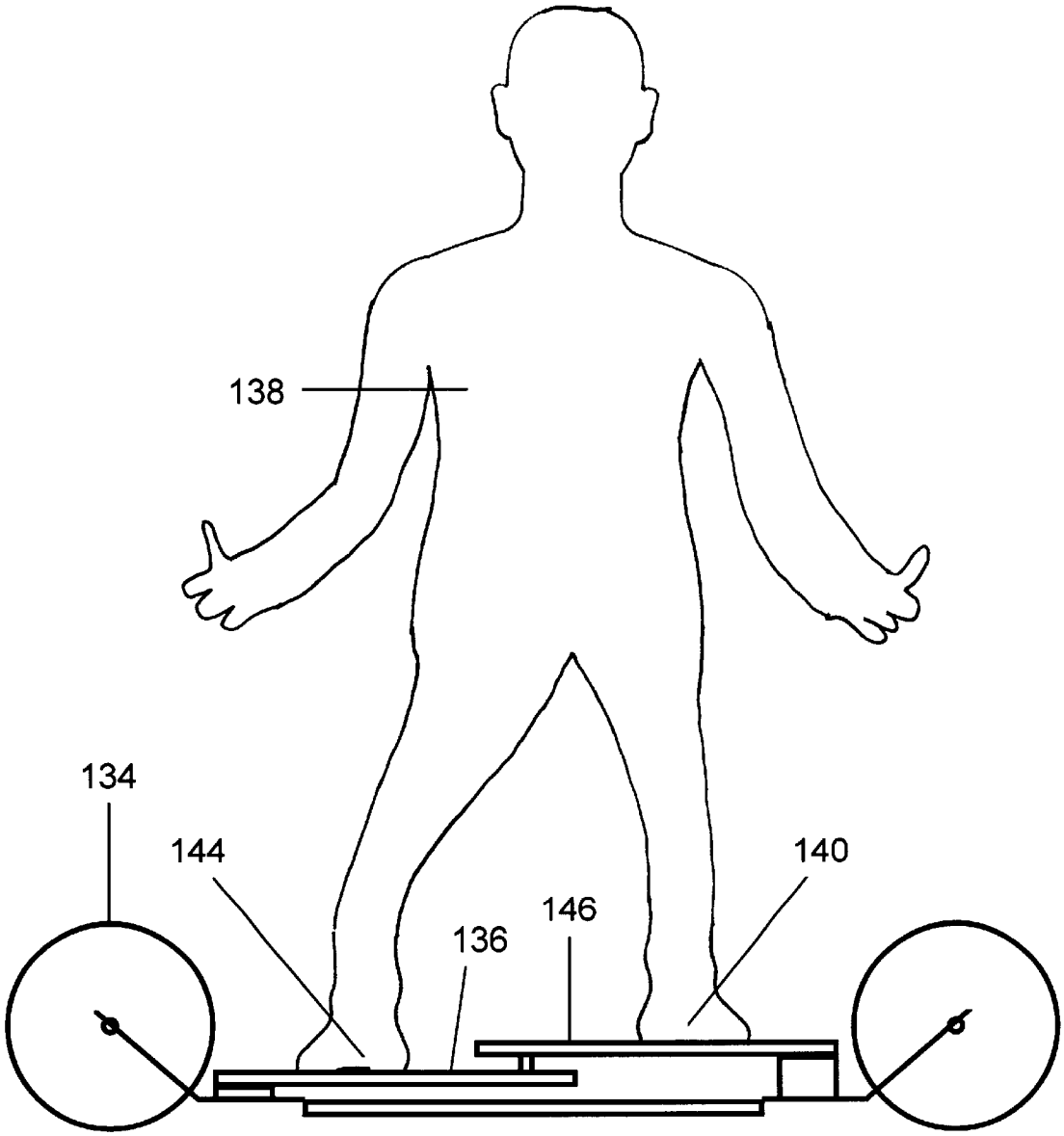
FIG. 12 is a side view of a user riding the current invention while coasting where the user's feet are positioned perpendicular to the long axis of the invention.

FIG. 11 and FIG. 12 are descriptions of the current invention 134 being ridden by user 138.

In FIG. 11 the user 138 is in the power stroke where the user is obtaining forward motion by moving his/her right foot 140 against the ground 142. The user's left foot 144 rests on the rear board member 136. While this description describes the user's left foot remaining on the board while driving off the ground with the user's right foot; the opposite arrangement is also possible.

In FIG. 12 the user has gained sufficient forward motion and is now coasting. The user 138 has repositioned his/her feet 140 and 144 to a position pointing perpendicular to the long axis of the invention 134. The user's left foot 140 is on the rear board member 136 and the user's right foot 144 is on the front board member 146. The user 138 can now affect direction changes of the invention 134 by changing the orientation of his/her feet relative to each other without lifting either foot off the invention. Moving the user's feet inward with his/her toes being closer than his/her heels causes the device to move to the left. Moving the user's feet outward with his/her toes being farther apart than his/her heels causes the device to move to the right.

I claim:

1. An articulated two wheeled board comprising:

a front horizontal planar board member;

a rear horizontal planar board member;

a front fork assembly having a rearward end rigidly connected to a forward end of the front board member and a pair of fork members extending forwardly and upwardly from the forward end of the front board member;

a rear fork assembly having a forward end rigidly connected to a rearward end of the rear board member and a pair of fork members extending rearwardly and upwardly from the rearward end of the rear board member;

a single front wheel rotatably supported between the pair of fork members of the front fork assembly;

a single rear wheel rotatably supported between the pair of fork members of the rear fork assembly;

a pivot connection for connecting a rearward end of the front board member to a forward end of the rear board member for permitting pivotal movement therebetween about a vertical axis while maintaining the front and rear board members in a substantially parallel relationship; and a flexible member extending below the front and rear board members for maintaining the front and rear wheels in a longitudinally aligned orientation, the flexible member having a forward end connected to the rearward end of the front fork assembly and a rearward end connected to the forward end of the rear fork assembly.

2. The articulated two wheeled board according to claim 1, wherein the pivot connection includes a pivot bolt, two thrust bearings, and a nut.

3. The articulated two wheeled board according to claim 2 wherein the pivot connection further includes four thrust bearing races.

* * * * *